US009926774B2

(12) United States Patent
Fontenot et al.

(10) Patent No.: US 9,926,774 B2
(45) Date of Patent: Mar. 27, 2018

(54) METHODS OF PRODUCING WITH MULTI-SIDETRACKED MOTHER WELLBORES

(71) Applicant: CONOCOPHILLIPS COMPANY, Houston, TX (US)

(72) Inventors: Kyle R. Fontenot, Sealy, TX (US); Matthew R. Wiens, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 43 days.

(21) Appl. No.: 15/002,497

(22) Filed: Jan. 21, 2016

(65) Prior Publication Data

US 2016/0215605 A1 Jul. 28, 2016

Related U.S. Application Data

(60) Provisional application No. 62/106,288, filed on Jan. 22, 2015.

(51) Int. Cl.
*E21B 43/14* (2006.01)
*E21B 43/30* (2006.01)

(52) U.S. Cl.
CPC ..... *E21B 43/305* (2013.01); *E21B 43/14* (2013.01)

(58) Field of Classification Search
CPC .... E21B 7/046; E21B 41/0035; E21B 43/305; E21B 43/14; E21B 43/30
See application file for complete search history.

(56) References Cited

U.S. PATENT DOCUMENTS 8,430,187 B2 4/2013 Hearn
2008/0271924 A1* 11/2008 Lurie ..... E21B 4/04 175/57
2014/0345855 A1* 11/2014 Wilfing ..... E21B 43/305 166/245

* cited by examiner

*Primary Examiner* — Catherine Loikith
(74) *Attorney, Agent, or Firm* — ConocoPhillips Company

(57) ABSTRACT

Methods produce hydrocarbons from an unconventional reservoir using a number of sidetrack lateral wells. A first of the lateral wells is drilled and produced before being closed for drilling of a subsequent lateral well. Drilling and production from such horizontal laterals alternates between first and second mother wellbores. One mother wellbore thereby undergoes drilling and completion while the other mother wellbore is in production.

12 Claims, 8 Drawing Sheets

METHODS OF PRODUCING WITH MULTI-SIDETRACKED MOTHER WELLBORES

PRIOR RELATED APPLICATIONS

This application is a non-provisional application which claims benefit under 35 USC § 119(e) to U.S. Provisional Application Ser. No. 62/106,288 filed Jan. 22, 2015 entitled "MULTI-SIDETRACKED WELLBORE," which is incorporated herein in its entirety.

FEDERALLY SPONSORED RESEARCH STATEMENT

Not applicable.

REFERENCE TO MICROFICHE APPENDIX

Not applicable.

FIELD OF THE DISCLOSURE

The disclosure relates to multilateral wellbore drilling, particularly for unconventional oil plays.

BACKGROUND OF THE DISCLOSURE

Unconventional oil is petroleum produced or extracted using techniques other than the natural mechanisms relied on by conventional methods. Oil industries and governments across the globe are investing in unconventional oil sources due to the depletion of conventional oil reserves.

Horizontal drilling and stimulations known as "fracking" have become increasingly important to the oil industry in recent years, especially for unconventional oil recovery. While horizontal wells have been drilled for many years, only recently have the link between this type of well and fracking (fracturing rock by pumping large volumes of proppant to create permeability, channels where the oil and gas can flow) provided a cost-effective alternative to conventional vertical well drilling. Although drilling a horizontal well costs substantially more than its vertical counterpart, a horizontal well frequently improves production by a factor of five, ten or even twenty in naturally-fractured reservoirs. Generally, projected productivity from a horizontal wellbore must triple that of a vertical wellbore for horizontal drilling to be economical. This increased production maximizes the return on investment.

Horizontal drilling makes reservoirs in urban areas, permafrost zones and deep offshore waters more accessible. Other applications for horizontal wellbores include periphery wells, thin reservoirs that would require too many vertical wellbores, and reservoirs with coning problems in which a horizontal wellbore could be optimally distanced from the fluid contact.

Some horizontal wellbores contain additional wellbores extending laterally from the primary vertical wellbores. Vertical wellbores containing more than one lateral wellbore are referred to as "multilateral" wells. Since the 1980s, multilateral wells are becoming increasingly important, both from the standpoint of new drilling operations and from the increasingly important standpoint of reworking existing wellbores, including remedial and stimulation work.

To reduce environmental impact at the surface and for economic reasons, many wells employ a single vertical mother wellbore having one or more multilateral junctions.

The multilateral junctions allow multiple lateral wells to extend from the mother wellbore beneath the surface, which may increase oil recovery while reducing costs.

There exists a need for improved multilateral drilling techniques to increase oil production and reduce cost. Ideally, the method allows for the maximum number of laterals for a given pay potential, yet still minimize surface impact.

SUMMARY OF THE DISCLOSURE

Described herein is a novel system and method of drilling wellbores for reservoirs containing unconventional hydrocarbons. In particular, at least one mother wellbore is drilled into a reservoir and a horizontal lateral provided to penetrate a horizontal pay zone. The first lateral is produced until some predetermined criterion is achieved. This criterion can be a certain time, a certain amount of production, and the like. Then, the first lateral is plugged, and a next sidetrack lateral well is drilled and produced. This continues sequentially until the horizontal pay zones have all been tapped. Once the maximum number of lateral wells is completed and production drops below a certain amount in the last well, all (or some portion) lateral wells are opened and produced together.

A benefit of the novel method is the minimization of surface impact using fewer well heads on the surface while maximizing reservoir contact and reduction in associated costs. There are fewer surface water penetrations, fewer cuttings, and less cement, among other benefits. Further, a smaller number of pads, and thus, facilities are needed when multiple sidetracks are added to a single mother wellbore. Additionally, sidetracks can be added to zones that were not economically feasible with a single horizontal well. In this sense, the new zones only have to cover the cost of the sidetrack and not the entire lateral and vertical system along with facility construction.

The mother wellbore can be any conventional shape used in hydrocarbon recovery, such as industry standard "pregnant belly" or vertical, but has a larger diameter wellbore than is typical. Vertical wells are preferred under most conditions because they are easier to drill, run tools and casing, and place or remove liners or pumps for production. However, the present method can be used on any shape wellbore. If curved, the mother wellbore may be cemented through the curve to the targeted horizon to prevent the wellbore from collapsing. However, this is not considered a requirement.

For some embodiments, the mother wellbore described herein is a larger intermediate wellbore than would normally be drilled. The larger size is needed to accommodate the equipment during sidetracks and at the end of the production life when all the lateral wells are combined. Depending on the reservoir conditions, an optional production string is installed in the mother wellbore to reduce wear on the intermediate casing string. Intermediate casing is required when zones above the pay zone need to be protected or do not have the strength to withstand the mud weight needed to drill to/in the pay zone.

The existing industry standard for oil and gas casing was established by the American Petroleum Institute in Specification 5CT (located at www.api.org). It specifies the length, thickness, tensile strength and composition of casing for a given situation and is the most commonly used standard for the selection of oil and gas casing. In some embodiments of the present system, the size of the mother wellbore casing should be at least one size bigger than the industry standard for a given situation.

Typically, the mother wellbore is drilled to or below the lowest pay zone with recoverable hydrocarbon and the first lateral well extends from this depth. From there, sidetracks can be added at any point above the first lateral well. This is especially true for vertical wells. However, the present method does not require drilling laterals from the bottom up, and allows for sidetracks to be added below the first lateral well, too.

In practice, a mother wellbore is often drilled near the edge of a lease line with the horizontal laterals extended out towards the other edge of a lease line. In this particular design, the subsequent laterals are oriented in vertical stacks with optional horizontal fanned laterals. For larger reservoirs with greater pay potential, multiple mother wellbores may be needed. In other designs, mother wellbores are located throughout the lease.

The sidetracks, or lateral wells, are drilled from the mother wellbore to a target zone of interest in the pay. Typically, the maximum number of sidetracks is that needed to recover hydrocarbons from all zones of interest.

The sidetracks can originate from the vertical mother wellbore or from the heel end of another lateral sidetrack, as suitable for the available equipment and degree of curvature. In other words, a sidetracked lateral can generate additional laterals thereoff.

As mentioned above, vertically stacked horizontal multilaterals can be used. However, any multilateral geometry can be utilized with the present invention including dual-opposed lateral, planar Y-well, and/or radial. Additionally, some sidetracked lateral wells may also have horizontal fanned offset laterals that extend from the sidetracked lateral well into the pay.

The length of the sidetrack is dependent on the reservoir conditions. For example, laterals can extend 1,500 to 5,000 feet (460 to 1,520 m) in the Barnett Shale basin in Texas, and up to 10,000 feet (3,000 m) in the Bakken formation in North Dakota.

The architecture of the novel wellbore described herein does not affect the stimulation process. Any stimulation processes, such as fracturing (fracking) or acidizing can be used to increase the flow of hydrocarbons through the lateral wells. Additionally, any completion technique can be used. We believe, however, that cemented lined laterals using the "plug and perf" method of completion is the preferred design based on current data.

When production drops, secondary lift systems may be positioned in the mother wellbore or sidetrack depending on optimal depletion. When one or more sidetracks are simultaneously open to the mother wellbore and producing, it may be beneficial to have all the production equipment at the lowest level. This can include pumps, such as beam, vertical hydraulic pumps, pumping jacks or electrical submersible pumps (ESP), or gas lift mandrels to bring the hydrocarbons to the surface.

In some embodiments, sleeves able to withstand fracturing pressure can be placed for each sidetracked lateral. This allows a user to open and close each lateral and, thus, control reservoir pressure in each zone. The sliding sleeves can be placed at the time each lateral is drilled or later. The sleeve can remain open through the production of that lateral, only to be temporarily closed off when the next lateral is drilled and produced. When production from the sidetracked laterals are combined in the last production stage, the sleeves can be open for all laterals or some combination of less than all laterals, depending on the thickness of the payzone, the porosity, permeability and productivity, as is known in the art.

In other embodiments, a special whipstock and milling assembly is used wherein the whipstock acts as a suspension plug for the main well adjacent to the new lateral being drilled, in addition to providing a kick off angle for the milling assembly to create a window for the new sidetrack. This special whipstock can be drillable or easily removed from the main well when all the laterals are connected. In yet other embodiments, the whipstock does not act as a plug and is removed with the milling assembly.

In another embodiment, a centrally located horizontal well is drilled first, with each subsequent sidetrack laterals drilled above and below the horizontal well and intersecting the horizontal well at spaced locations. Production then occurs from all wells simultaneously.

This summary is provided to introduce a selection of concepts that are further described below in the detailed description. This summary is not intended to identify key or essential features of the claimed subject matter, nor is it intended to be used as an aid in limiting the scope of the claimed subject matter.

As used herein, "sidetracked laterals" means horizontal or nearly horizontal lateral wells drilled to extend laterally through a hydrocarbon-containing pay.

As used herein "horizontal" refers to a deviated well that is within 45° of parallel with the earth's surface. Of course, efforts are made where possible to follow any updip (or down) of the payzone, such that the lateral remains within the payzone.

"Vertical" refers to wells that are less than 45° from perpendicular to the earth's surface.

Horizontal laterals can originate from the vertical mother wellbore, or from the heel end of a horizontal wellbore, as appropriate for the degree of curvature that can be obtained by the equipment available.

A "pregnant belly" or "pregnant woman" well refers herein to a vertical well that is significantly bowed, as as to resemble a pregnant woman in profile, so that the bottom end is curving towards a series of horizontal pay zones. It can be significantly easier to drill laterals from the bottom end of such a well since the well is already tending towards horizontal at the bottom. This also allows for the horizontal's last stage of perfs to be closest to the lease line, increasing economics.

As used herein, "plug and perf" or "plug and perforated" refers to a system that creates multiple hydraulic fractures in a horizontal well completed with a cemented casing or liner. A section is sealed (plugged), perforated and stimulated, then the next section is sealed, perforated and stimulated.

As used herein, "industry standard" refers to API guidelines and specifications used by members in the oil and gas industry.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| BS | Bone Spring |
| ESP | electrical submersible pumps |
| PSI | Pressure per square inch |
| TD | True measured depth |

DESCRIPTION OF EMBODIMENTS OF THE DISCLOSURE

Figure 1:
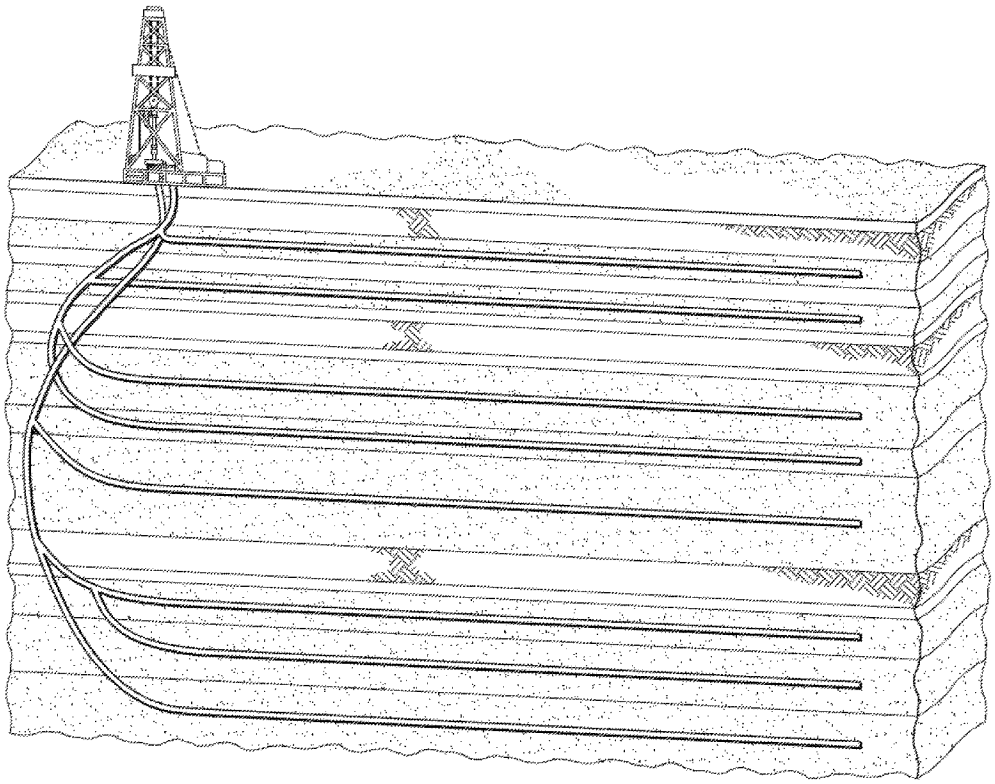
FIG. 1. displays one embodiment of the present system having two "pregnant belly" mother wellbores with multiple sidetracked lateral wells extended therefrom.

The disclosure provides a novel wellbore system and method of drilling which increases the amount of hydrocarbon recovered from a target zone.

The disclosure includes any one or more of the following embodiments, in any combination thereof:

A method for producing hydrocarbon from a subsurface formation having a plurality of stacked horizontal pay zones, comprising drilling and casing a mother wellbore in a subsurface formation having a plurality of stacked horizontal pay zones containing hydrocarbons; drilling a horizontal lateral well from the mother wellbore into a first horizontal payzone; lining the first horizontal lateral well; stimulating the first horizontal lateral well; producing hydrocarbon from said first horizontal lateral well until a first pre-selected production criterion is achieved; closing this horizontal lateral well sequentially repeating these steps for a sequential plurality of lateral wells. Eventually, the plurality of lateral sidewells are opened up and combined when production of hydrocarbons from a last payzone slows.

A method for producing hydrocarbon from a subsurface formation having a plurality of stacked horizontal pay zones, comprising drilling and casing a mother wellbore in a subsurface formation having a plurality of stacked horizontal pay zones containing hydrocarbons, wherein the mother wellbore has a casing that is at least one size larger than industry standard; drilling a horizontal lateral well from the mother wellbore into a first horizontal payzone; lining and cementing the first horizontal lateral well; stimulating the first horizontal lateral well; producing hydrocarbon from said first horizontal lateral well until a first pre-selected production criterion is achieved; closing this horizontal lateral well sequentially repeating these steps for a sequential plurality of lateral wells. Eventually, the plurality of lateral sidewells are opened up and combined when production of hydrocarbons from a last payzone slows.

A method of producing hydrocarbon from a plurality of horizontal pay zones, comprising providing a plurality of horizontal lateral sidewells into a plurality of horizontal pay zones from a mother wellbore having a casing at least one size larger than industry standard, and sequentially producing each individual horizontal lateral sidewell until production from the last drilled individual horizontal lateral sidewell slows, then combining the plurality of horizontal lateral sidewells and producing from them.

A method of producing hydrocarbon from a plurality of horizontal pay zones, comprising providing first and second mother wellbores at a single pad, each mother wellbores having a casing at least one size larger than industry standard and having a plurality of horizontal lateral sidewells penetrating into a plurality of horizontal pay zones, and staggered producing individual horizontal lateral sidewell first from the first mother wellbore and then from the second mother wellbore.

Any of the above methods can use any shape of mother wellbore including pregnant belly and vertical. Further, each lateral can be produced until some criterion such as time, production pressure, and/or production level per day before it is closed and a new lateral is drilled.

In any of the above methods, the preferred simulating step is a plug and perforation fracturing step.

In any of the above methods, secondary lift equipment is used to produce hydrocarbons when all the lateral sidewells are combined. In some embodiments, electrical submersible pumps are preferred.

A whipstock and milling assembly for drilling the lateral wells is included in any of the above methods, wherein the whipstock can act as a suspension plug for the mother wellbore.

A whipstock-suspension plug can withstand 10,000 psi.

A whipstock-suspension plug may be easily removable or retrievable from the mother wellbore.

A whipstock-suspension plug may be drillable.

In drilling the presently described wellbore architecture, the following steps are performed. First, the pad is installed on the target drill site and all the rigging is brought to the site. A mother wellbore is then drilled using larger than normal casing. In some embodiments, this casing is only one size larger, in other embodiments, the casing can be two or more sizes larger. The larger casing size may be a component of this system because the wellbore has to be large enough so that production equipment of normal industrial size can be launched and service multiple sidetracked laterals. The effects of liners, sleeves and the like on the wellbore diameter need to be considered when choosing the appropriate casing size. The casing is then cemented into the wellbore.

The first lateral is drilled to total measured depth (TD). Any drilling technique in the art can be used, such as a bi-centered drillbit described in U.S. Pat. No. 8,430,187. The lateral has a smaller casing than the mother wellbore. Once drilled, a liner is cemented in the lateral. Openhole laterals can be used in place of cement.

In the present wellbore, any simulation method can be used on the lateral well. The first lateral well is produced until a predetermined criterion is achieved. This criterion can be an amount of time, e.g. 5 years, a percentage of production or until the pressure profile drops below a certain level. Once the first lateral well reaches the predetermined criterion, a temporary plug is suspended in the mother wellbore at the site of the first sidetrack well, thus temporarily halting production.

The site of the next sidetrack well to be drilled is usually above the first lateral well, but this is not essential. Typically, a whipstock and milling assemble is lowered into the mother wellbore and a window in the wellbore casing is milled out at the site of the whipstock. Then, the sidetracked well is drilled into the new zone of interest at a target TD using the same method as the first lateral well and having a smaller diameter casing than the mother wellbore. As with the previous lateral, the sidetrack well is cased and stimulated with e.g., a plug and perf technique.

The subsequent sidetrack well is produced until a predetermined criterion is met. This may be the same criterion as the initial lateral well or it may be different. Once the criterion is met, the sidetrack well is temporarily plugged and a new sidetrack well is drilled. This is repeated for a set number of years and/or for the number of target zones that need to be produced.

When the last sidetrack well's production falls below a certain level, the temporary plugs in many if not all of the lateral and sidetrack wells are removed, thus connecting the wells to the mother wellbore. These are then produced together.

In some embodiments, sleeves are installed in the mother wellbore at each sidetrack to allow an operator to selectively open and close each lateral well and control reservoir pressure in each zone. These sleeves need to withstand fracturing pressures if installed prior to stimulation.

In other embodiments, the whipstock can act as a suspension plug in the mother wellbore or one or more sidetrack wells. This special whipstock can then be easily removed or drilled through to open the plugged well. To successful plug the well, however, the whipstock needs to be certified as a suspension plug that can withstand pressures of at least 10,000 psi.

Once a plurality of lateral wells are in communication with the mother wellbore, the combined wells are produced. The sleeves and/or other techniques are used to bring all the open, producing lateral wells to the same pressure and production rate. This way, reservoir fluid flows up the mother wellbore instead of moving into a zone with lower pressure.

Figure 2:
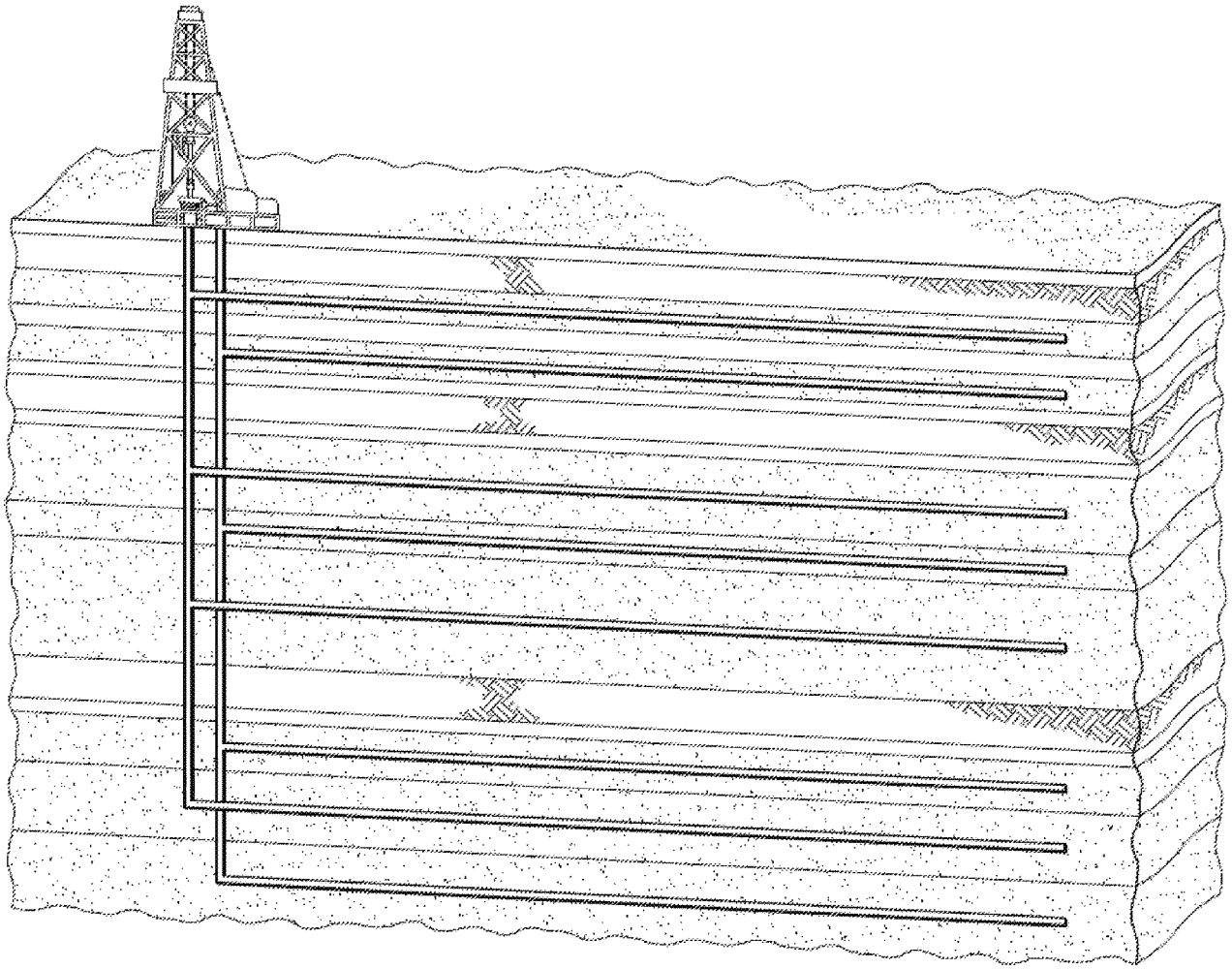
FIG. 2. displays one embodiment of the present system having two vertical mother wellbores with multiple sidetracked lateral wells extended therefrom.

This method of drilling the mother wellbore and subsequent lateral wells can be modified to accommodate other architectural features to the wellbore. For instance, multiple mother wellbores can be used for the same reservoir, as shown in FIGS. 1 and 2. The mother wellbore can be any shape as seen in FIG. 1 ("pregnant belly") and FIG. 2 (vertical). However, the shape affects the ease of lowering production equipment and should be considered during field development. It is also not necessary that the multiple mother wellbores be of the same size.

The present system and methods are exemplified with respect to a proposed drill plan described below and illustrated in FIG. 3-6, However, this is exemplary only, and the present system and methods can be broadly applied to any multilateral well design. The following is intended to be illustrative only, and not unduly limit the scope of the appended claims.

The Wolfcamp field located in West Texas and southern New Mexico in the Delaware Basin poses a unique unconventional reservoir. Most unconventional reservoirs have one to three horizons or pay zones with a couple of hundred feet of pay. However, Wolfcamp has just over 4,000 ft of pay and 9 horizons that are currently being tested for commerciality, with the major three horizons being Avalon, Bone Springs (BS) and Wolfcamp.

While most multilateral designs are able to handle the typical unconventional reservoirs with relatively few horizons, Wolfcamp presents a challenge because of the large number of horizons. Thus, a method is needed to place as many laterals as necessary to recover from the multiple pays in Wolfcamp. FIGS. 3-6 depict how the present method is expected to be applied to Wolfcamp in a proposed drill plan.

Figure 3:
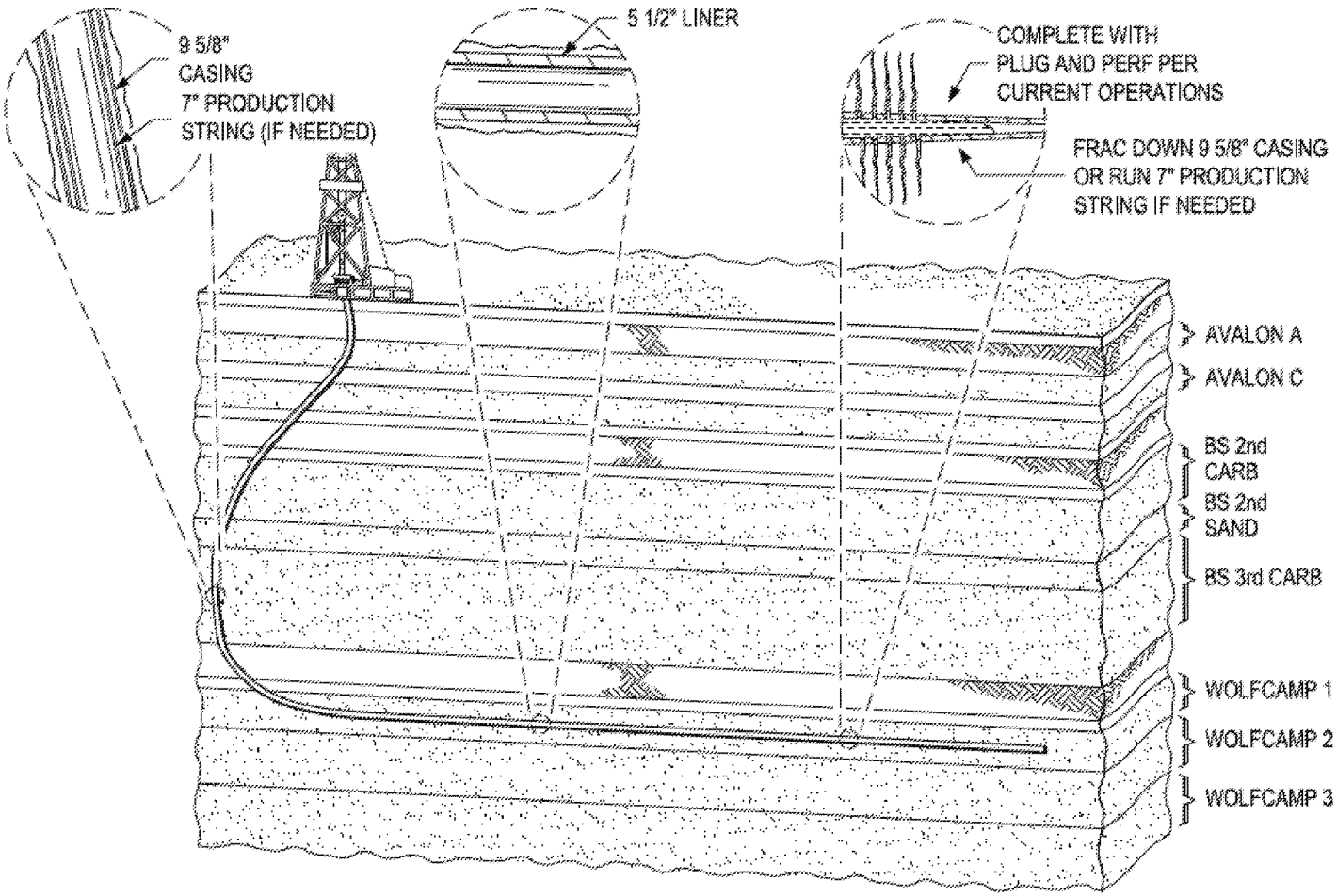
FIG. 3. displays a hypothetical first mother wellbore located in the Wolfcamp reservoir and measurements of various parts of the system according to one intended application.

First, a 'pregnant belly' well is drilled using a 9 ⅝" mother wellbore casing in the vertical section and a 5 ½" liner is hung and cemented in the horizontal well, or first lateral well, drilled to TD. The size of the casing and liner, shown in FIG. 3, are exemplary only and are specific to the reservoir.

The first lateral well is stimulated and completed using a plug and perf technique. Typically, a "plug and perf" simulation technique is used with cemented liners. Plug-and-perf includes pumping down a bottom hole assembly having an isolation tool and a setting toll on a wireline with perforating guns to a given horizontal location near the toe of the lateral. The plug is set, and the zone is perforated. The tools are then removed from the well, and a fracture stimulation treatment is pumped in. A set plug or ball-activated plug then diverts fracture fluids through the perforations into the formation. After this stage is completed, the next plug and perforations are initiated a bit further along the wellbore, and the process is repeated moving back to the heel of the well.

Figure 4:
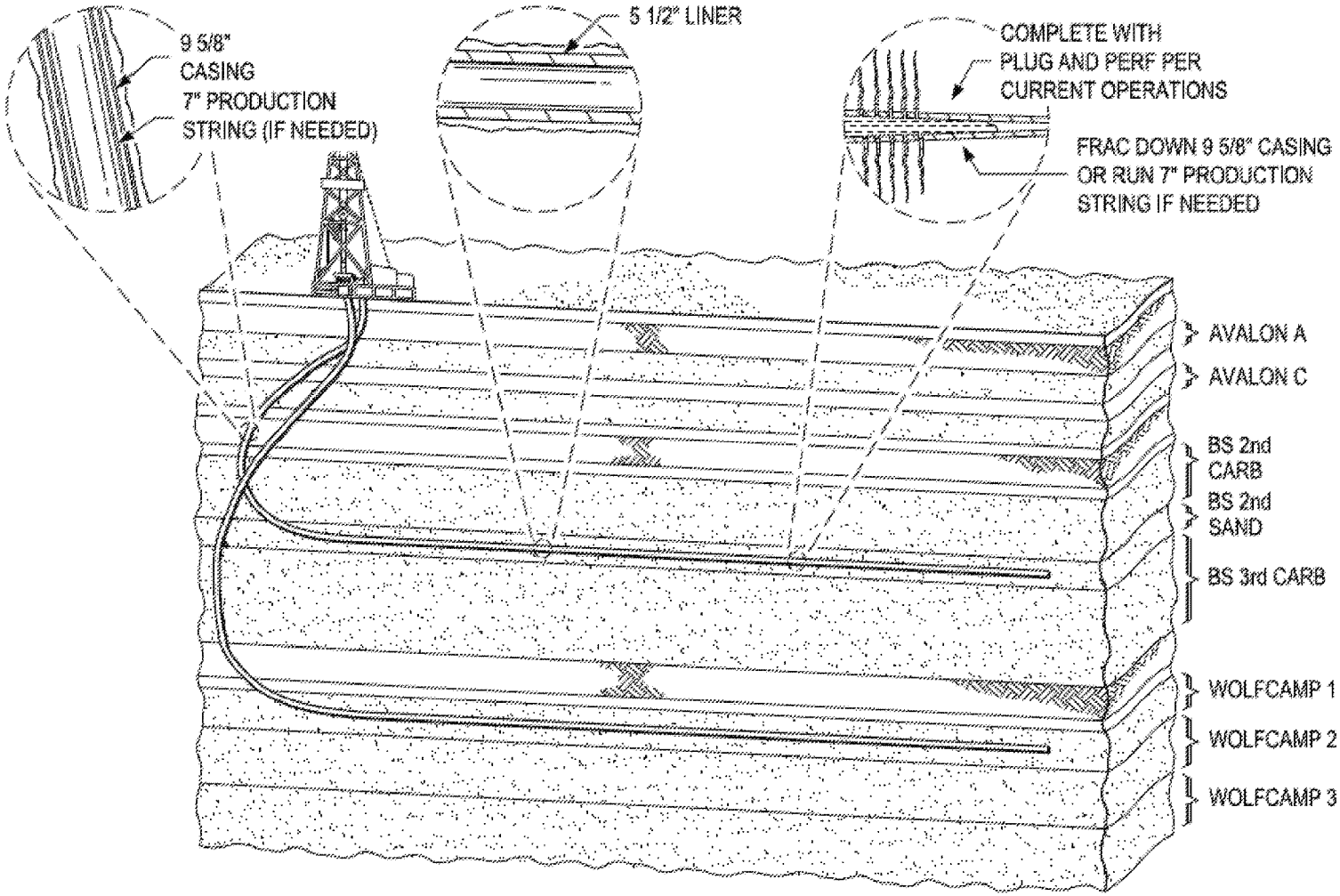
FIG. 4. displays a hypothetical second mother wellbore located in the Wolfcamp reservoir and measurements of various parts of the system according to one intended application. The second mother wellbore is drilled from the same pad as the first mother wellbore in FIG. 3.

This first well begins production as a second mother wellbore is being drilled/completed from the same rig site (FIG. 4). By using the same site, operations can be centrally located and the surface impact can be reduced. The second wellbore can be drilled into e.g., the Bone Spring sand layer and completed just like the first mother wellbore.

Expected recovery in Wolfcamp is 70-80% in the first 5 years. Thus, the first and second mother wellbore, each with one lateral well, is produced for about 5 years, wherein production is expected to level off.

Figure 5A:
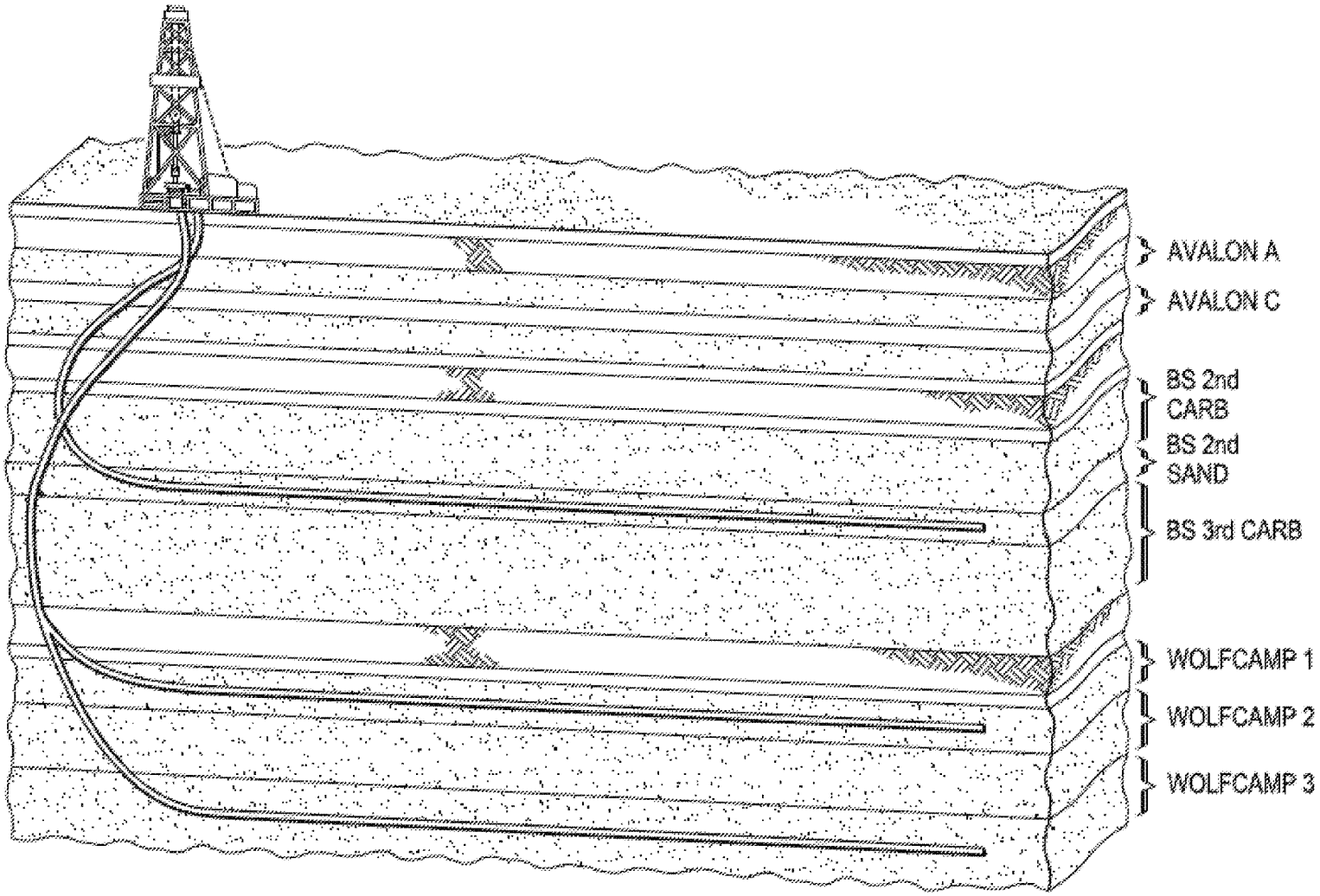
FIG. 5A. illustrates a hypothetical first sidetrack on a first mother wellbore and FIG. 5B displays an expected production profile for both mother wellbores.
Figure 5B:
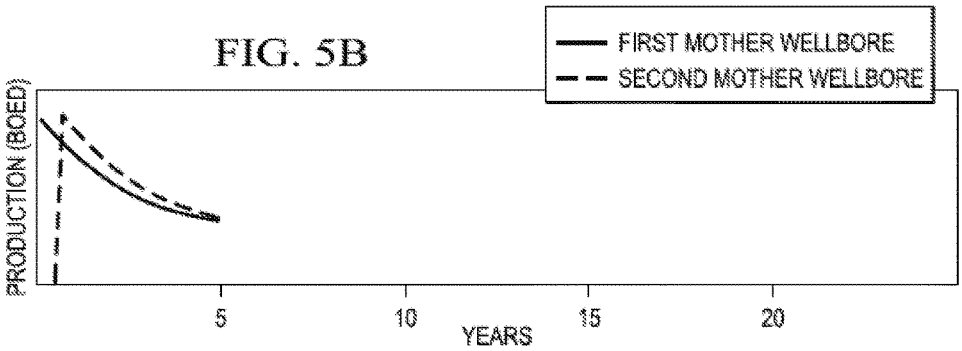

Once production begins to slow in the first mother wellbore as shown in FIG. 5B, a second lateral is drilled in that wellbore (FIG. 5A), whilst production continues from the second mother wellbore. In this way production and drilling can alternate in the two wellbores without losing production time.

First, the production string, if any, is removed from the wellbore. Then, a whipstock/suspension plug/milling assembly is run into the wellbore to cut the window.

The milling assembly has to be removed before the drill bit is launched into the wellbore. However, the assembly has a suspension plug on the whipstock that remains in the first lateral well, thus sealing it while the second lateral is being drilled. Alternatively, a temporary plug can be inserted between the milling assembly and the first lateral well or the whipstock can be separate from the milling assembly and can be suspended above the first lateral well.

This sidetracked lateral in the first mother wellbore is completed as described above and displayed in FIG. 5A. The production in the first mother wellbore increases from the production of the new sidetrack lateral well.

Figure 6A:
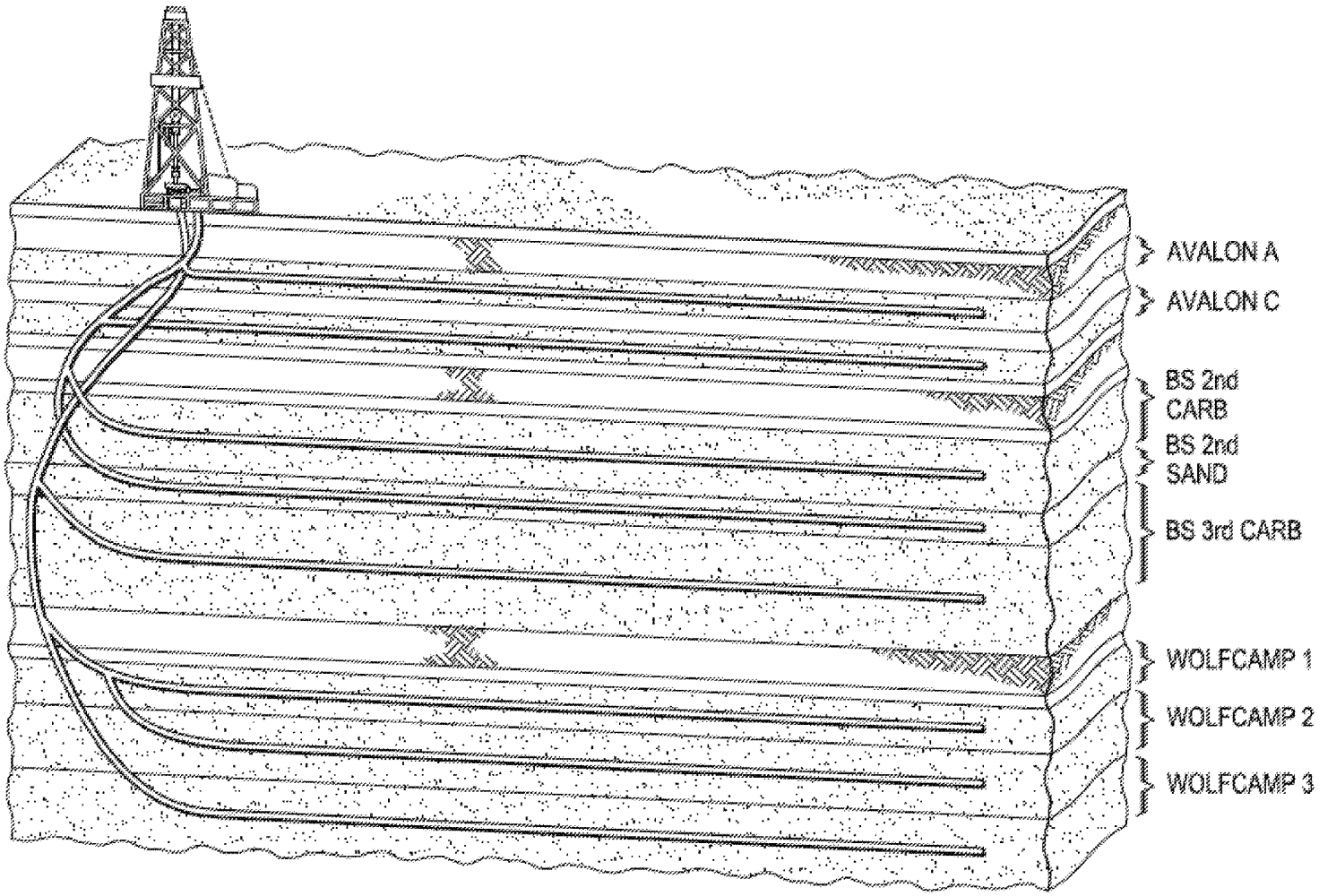
FIG. 6A illustrates hypothetical first and second mother wellbore with multiple sidetrack laterals drilled into the pays of Wolfcamp reservoir and FIG. 6B displays an expected production profile for both mother wellbores. The change in production can be seen for each added sidetrack.
Figure 6B:
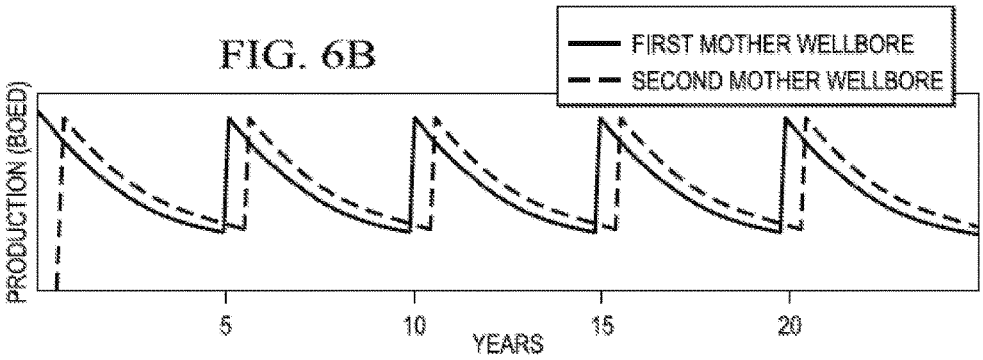

Additionally sidetracked laterals are added to each mother wellbore to increase production, as seen in FIG. 6A. This continues until a new sidetrack is no longer expected to increase production or the number of pay zones have been tapped. As seen in the production profile in FIG. 6B, each new sidetrack lateral resulted in ascension in production.

Eventually, secondary lift systems may be necessary to recover hydrocarbons. At this point, all of the temporary plugs and/or whipstocks are removed for each sidetracked lateral to combine production. Depending on the whipstock or plug used, it may be possible to simply drill the center out to allow access to the plugged lateral.

Seal assemblies with sliding sleeves can be installed on each lateral to give an operator control of the reservoir pressure. The operator then has the ability to turn on (open) whichever lateral(s) are needed to produce the remaining hydrocarbons. Additionally, the same pressure and rate of fluid flow is maintained such that the hydrocarbons flow up the mother wellbore instead of moving to lower pressure regions. Sliding sleeves may help control these rates.

Production equipment for the secondary lift system is also installed, typically in the lowest lateral. Hydrocarbons are produced from all laterals simultaneously until such time as it is not economically feasible. Then, all equipment is removed and the wells are permanently plugged and abandoned.

It is also expected that all the sidetracks can be drilled at the same time and sleeved using a slidable sleeve system, allowing for sequential use of the sidetracks. This prevents continuous pulling up of the production string. Sleeves may be capable of remaining in the well and operating under the fracturing and recovery conditions over the life of the well.

While the above example is described with a pregnant belly mother well design, other designs can be used such as substantially vertical wells.

The invention claimed is:

1. A method for producing hydrocarbon from a subsurface formation having a plurality of stacked horizontal pay zones, comprising:

a) drilling and casing a first mother wellbore in a subsurface formation having a plurality of stacked horizontal pay zones containing hydrocarbons;

b) drilling a first horizontal lateral well from said first mother wellbore into a first horizontal payzone;

c) lining said first horizontal lateral well;

d) stimulating said first horizontal lateral well;

e) producing hydrocarbon from said first horizontal lateral well until a first pre-selected production criterion is achieved;

f) closing said first horizontal lateral well;

g) sequentially repeating steps b)-f) for a sequential plurality of the lateral wells;

h) opening said plurality of lateral wells when production of hydrocarbons from a last payzone slows; and i) producing from a combined plurality of the lateral wells, wherein a second mother wellbore is drilled on a same pad as said first mother wellbore, and drilling and production from horizontal laterals alternate between said first and second mother wellbores, such that one mother wellbore is undergoing drilling and completion while the other mother wellbore is in production.

2. The method of claim 1, wherein said lining of first horizontal lateral well is cemented.

3. The method of claim 1, wherein said first mother wellbore is a vertical wellbore and has a casing that is at least one size larger than industry standard.

4. The method of claim 1, wherein said first mother wellbore is a pregnant belly wellbore.

5. The method of claim 1, wherein said pre-selected production criterion is a unit of time.

6. The method of claim 1, wherein said pre-selected production criterion is a production pressure.

7. The method of claim 1, wherein said pre-selected production criterion is a production level per day.

8. The method of claim 1, wherein said stimulating step d) is a plug and perforation fracturing technique.

9. The method of claim 1, wherein said producing step i) uses secondary lift equipment to produce said hydrocarbons.

10. The method of claim 9, wherein said secondary lift equipment is an electrical submersible pump.

11. The method of claim 1, further including installing slidable sleeves on said lateral wells and controlling reservoir pressure by opening and closing one or more slidable sleeves while producing hydrocarbon from said combined plurality of horizontal lateral wells.

12. The method of claim 1, wherein one or more lateral horizontal wells intersect with a primary horizontal lateral well.

* * * * *